US008334813B2

(12) United States Patent
Tadokoro et al.

(10) Patent No.: US 8,334,813 B2
(45) Date of Patent: Dec. 18, 2012

(54) AUTOMOTIVE GLASS ANTENNA

(75) Inventors: Shingo Tadokoro, Matsusaka (JP); Masanori Kaihatsu, Matsusaka (JP); Masaki Ando, Yokohama (JP)

(73) Assignee: Central Glass Company, Limited, Ube-shi (JP)

( * ) Notice: Subject to any disclaimer, the term of this patent is extended or adjusted under 35 U.S.C. 154(b) by 443 days.

(21) Appl. No.: 12/739,116

(22) PCT Filed: Oct. 17, 2008

(86) PCT No.: PCT/JP2008/068872
§ 371 (c)(1),
(2), (4) Date: Apr. 21, 2010

(87) PCT Pub. No.: WO2009/054324

PCT Pub. Date: Apr. 30, 2009

(65) Prior Publication Data

US 2010/0220020 A1 Sep. 2, 2010

(30) Foreign Application Priority Data

Oct. 23, 2007 (JP) ..... 2007-275572

(51) Int. Cl.
*H01Q 1/32* (2006.01)

(52) U.S. Cl. ..... 343/713; 343/704

(58) Field of Classification Search ..... 343/704, 343/711–713, 728, 741–744, 748, 850, 856, 343/860
See application file for complete search history.

(56) References Cited

U.S. PATENT DOCUMENTS 5,177,493 A 1/1993 Kawamura
5,334,989 A * 8/1994 Nagayama et al. ..... 343/713
5,461,391 A * 10/1995 Ohnishi et al. ..... 343/713
5,933,119 A 8/1999 Fujii et al.
(Continued)

FOREIGN PATENT DOCUMENTS

JP 3-184401 A 8/1991
(Continued)

OTHER PUBLICATIONS

International Search Report including partial translation dated Jan. 27, 2009 and PCT/ISA/237 Form (Eight (8) pages).
(Continued)

*Primary Examiner* — Vibol Tan

(74) *Attorney, Agent, or Firm* — Crowell & Moring LLP

(57) ABSTRACT

An automotive glass antenna which is an FM radio broadcast wave receiving antenna provided in blank spaces below or lateral sides of a defogger of a window glass provided in a rear door of a hatchback type of an automobile, the automotive glass antenna including: a first auxiliary element including at least a first auxiliary horizontal strip which branches from a lower end of a bus bar of the defogger, or from a lowermost horizontal heater strip, and which extends along the lowermost heater strip; a second auxiliary element including at least a second auxiliary vertical strip which extends from an upper end of each bus bar through an extension line, and which is apart from the bus bar in an outward direction; a horizontal element which extends in a substantially horizontal direction from a feed point provided near a lower portion of the bus bar of the defogger, and which is adjacent to the first auxiliary horizontal strip to achieve a capacitive coupling; and a vertical element which extends from the feed point along an outside of the bus bar, and which is adjacent to the bus bar to achieve the capacitive coupling.

10 Claims, 4 Drawing Sheets

U.S. PATENT DOCUMENTS

| | | | | |
|---|---|---|---|---|
| 6,504,512 | B2 * | 1/2003 | Tabata | 343/713 |
| 7,019,700 | B2 * | 3/2006 | Fujii et al. | 343/713 |
| 7,091,914 | B2 * | 8/2006 | Noguchi et al. | 343/713 |
| 7,227,503 | B2 * | 6/2007 | Baba et al. | 343/713 |
| 7,558,555 | B2 * | 7/2009 | Nagy | 455/277.1 |

FOREIGN PATENT DOCUMENTS

| | | | |
|---|---|---|---|
| JP | 5-251918 | A | 9/1993 |
| JP | 7-263934 | A | 10/1995 |
| JP | 9-153716 | A | 6/1997 |
| JP | 2003-78319 | A | 3/2003 |
| JP | 2003-142913 | A | 5/2003 |

OTHER PUBLICATIONS

Supplementary European Search Report dated Oct. 25, 2011 (seven (7) pages).

* cited by examiner

AUTOMOTIVE GLASS ANTENNA

TECHNICAL FIELD

The present invention relates to a glass antenna that is formed on a rear window glass of an automobile, and which receives FM radio broadcast waves, particularly to a glass antenna that is suitable for receiving FM radio broadcast waves even when there is no space above heating conductive strips (defogger) of a rear window glass of an automobile of a hatchback type, and there are spaces on lateral sides of the defogger and a space below the defogger.

BACKGROUND OF THE INVENTION

Hitherto, glass antennas for receiving AM radio broadcast waves and FM radio broadcast waves have higher gain as an area surrounded by antenna strips increases. Therefore, these glass antennas are often provided on the rear window glass of the automobile which is easy to ensure a large area for obtaining a good reception gain. The rear window glass of the automobile is often formed on its central region with defogging heater strips for ensuring rear visibility at the driving in rain. Therefore, in a case in which the glass antenna is formed on the rear window glass, it has been forced to be formed on the blank space of the peripheral portions of the defogging heater strips, especially, the blank spaces above or below the defogging heater strips.

Moreover, the horizontal strips, the vertical strips and so on of the antenna provided around the defogging heater strips were often adjacent to the heater horizontal strips, the bus bars and so on of the defogging heater strips. With this, it was possible to use the radio wave received by the defogging heater strips as the antenna, and to improve the reception gain.

For example, Japanese Patent Application Publication No. 2003-78319 (patent document 1) discloses an automotive glass antenna including defogging heater strips which are provided on a rear window glass, and which has a plurality of heating conductive strips, and bus bars connected with ends of the plurality of the heating conductive strips. This glass antenna includes a feed point provided in a peripheral portion of the glass in blank spaces above or below the defogging heater strips; a first element including at least a first horizontal strip which extends from the feed point, and which achieves the capacitive coupling with the heating conductive strips; and a second element including a vertical strip which extends from the feed point, which is disposed outside the bus bar, and which is connected with the bus bar at an end of the vertical strip or by branching from a middle portion of the vertical strip.

Moreover, Japanese Patent Application Publication No. 5-251918 (patent document 2) discloses an automotive glass antenna including a first antenna including horizontal strips and vertical strips provided in a space above defogging heater strips of an automotive rear window glass, and at least a second antenna including a first element which is connected with a feed point arranged in a lateral area under the defogging heater strips, which extends in the upward direction outside the defogging heater strips, and which further extends in the horizontal direction in a blank space above the first antenna or in a blank space of the first antenna; and a second element which is connected with the feed point, which extends in the horizontal direction in the blank space below the defogging heater strips, and which is folded to extend in the horizontal direction toward the feed point.

Patent Document 1: Japanese Patent Application Publication No. 2003-78319

Patent Document 2: Japanese Patent Application Publication No. 5-251918

SUMMARY OF THE INVENTION

In the patent documents 1, 2, there are relatively large spaces for the antenna in the upper blank space of the defogging heater strips of the automotive rear glass. The FM radio receiving antennas are provided in these spaces. Ends of the vertical strips of the FM radio receiving antennas are directly connected, respectively, with the bus bars of the defogging heater strips.

However, it may not be possible to ensure the space for the antenna in the upper blank space of the defogging heater strips due to the design or the shape of the body or the window glass of the automobile, or the shape of the defogging heater strips according to the design or the shape of the body or the window glass of the automobile. Therefore, there was a problem to decrease the reception gain when the antenna was provided in a blank space other than the upper blank space.

It is, therefore, an object of the present invention to provide an automotive glass antenna to be devised to solve the above-mentioned problems, to receive the FM radio broadcast wave with the high gain when the antenna is provided in a blank space around the defogger which is other than the upper blank space in a case in which the automotive rear window glass can ensure little space for the antenna in the upper blank space of the defogger of the automotive rear window glass, and moreover to receive the FM radio broadcast wave with the high gain even when the automotive rear door is a hatchback type, and made from the resin.

That is, the present invention is an automotive glass antenna which is an FM radio broadcast wave receiving antenna provided in blank spaces below or lateral sides of a defogger of a window glass provided in a rear door of a hatchback type of an automobile, the automotive glass antenna including: a first auxiliary element including at least a first auxiliary horizontal strip which branches from a lower end of a bus bar of the defogger, or from a lowermost horizontal heater strip, and which extends along the lowermost heater strip; a second auxiliary element including at least a second auxiliary vertical strip which extends from an upper end of each bus bar through an extension line, and which is apart from the bus bar in an outward direction; a horizontal element which extends in a substantially horizontal direction from a feed point provided near a lower portion of the bus bar of the defogger, and which is adjacent to the first auxiliary horizontal strip to achieve a capacitive coupling; and a vertical element which extends from the feed point along an outside of the bus bar, and which is adjacent to the bus bar to achieve the capacitive coupling.

Alternatively, the present invention is the automotive glass antenna as mentioned above, that the automotive glass antenna includes a third auxiliary element including a third auxiliary horizontal strip which extends from the upper end of each bus bar of the defogger through the extension line along an upper side of an uppermost heater horizontal strip of the defogger, to a portion near a middle portion of the uppermost heater horizontal strip, and which is adjacent to the upper side of the uppermost heater horizontal strip.

Alternatively, the present invention is one of the automotive glass antennas mentioned above, that the automotive glass antenna includes a fourth auxiliary element including a fourth auxiliary horizontal strip which branches from a substantially middle portion of the lowermost horizontal heater strip of the defogger, and which extends along the lowermost horizontal heater strip in a direction opposite to the feed point, and a fourth auxiliary vertical strip which extends from an end of the fourth auxiliary horizontal strip, and which is adjacent to an outside of the bus bar.

Alternatively, the present invention is one of the automotive glass antennas mentioned above, that the rear door is made from a resin; metal reinforcement frames are provided at least in upper side, both lateral sides of a periphery portion of an opening portion of the rear door; the metal reinforcement frames are grounded to a metal body; the second auxiliary vertical strip of the second auxiliary element is superimposed with or adjacent to the metal reinforcement frame with a distance to achieve the capacitive coupling.

Alternatively, the present invention is one of the automotive glass antennas mentioned above, that the rear window glass is a window glass having no blank space above the defogger for providing the antenna; and the FM broadcast wave receiving antenna provided in the blank spaces below or on the lateral sides of the rear window glass is arranged to achieve a diversity reception with a roof mount antenna for receiving AM/FM broadcast waves.

DETAILED DESCRIPTION

Figure 1:
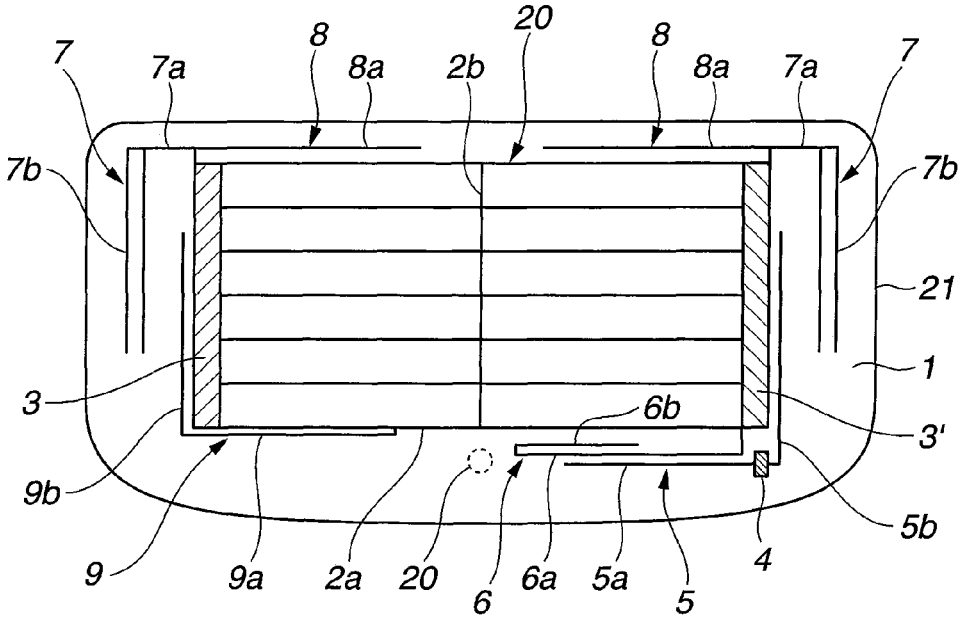
FIG. 1 is a front view showing a first embodiment provided to a window glass of an automotive rear door, and according to the present invention.

Hereinafter, effects by the embodiments are illustrated.

When the rear window glass of the automobile has a short longitudinal length, it is not possible to ensure a space for an antenna which is for receiving AM/FM radio broadcast waves, and which needs a large area in an upper blank space above the defogger. In this case, even when the antenna is provided in peripheral blank spaces other than the upper blank space of the defogger, the defogger is used as the antenna, and first to fourth auxiliary elements including auxiliary horizontal strips, the auxiliary vertical strips and so on are provided in various portions of the defogger. With this, it is possible to improve the reception sensitivity of the FM radio broadcast wave, and to receive the FM broadcast wave with the high gain.

Moreover, the second vertical auxiliary element is provided for compensating the short longitudinal length of the heater strip of the defogger. With this, it is possible to lengthen the longitudinal length of the strip, and to become easy to receive the polarized wave in the vertical direction.

Moreover, in a case in which the rear door of the automobile is a hatchback type, and made from the resin, the second auxiliary element branching from the defogger is adjacent to the metal reinforcement frames provided at least on upper side and right and left both sides of the opening portion of the door made from the resin, so as to achieve the capacitive coupling. With this, the defogger receives the radio wave received by the automobile body through the metal reinforcement frames and the second auxiliary element. Moreover, it is possible to receive the FM radio broadcast wave with the high gain through the first auxiliary element and the FM radio broadcast wave receiving antenna which achieve the capacitive coupling with the first auxiliary element.

Moreover, the FM radio broadcast wave receiving antenna of this embodiment and the roof mount antenna (RMA) which is for receiving the AM/FM radio broadcast waves, and which is provided at a rear position of a roof of the automobile are arranged to achieve the diversity reception. With this, it is possible to receive the FM radio broadcast wave with the high gain.

Moreover, the horizontal element of this example is adjacent to the first auxiliary horizontal strip of the first auxiliary element which has a predetermined length, which branches from the lower end of the bus bar of the defogger or the lowermost one of the horizontal heater strips, and which extends along the lowermost one of the horizontal heater strips, so as to achieve the capacitive coupling. With this, it is possible to receive the radio wave of the horizontally polarized wave received by the horizontal heater strips of the defogger.

Moreover, the vertical element extending from the feed point along the outside of the bus bar of the defogger is adjacent to the bus bar to achieve the capacitive coupling. With this, it is possible to receive the radio wave of the vertically polarized wave received by the defogger.

Figure 3:
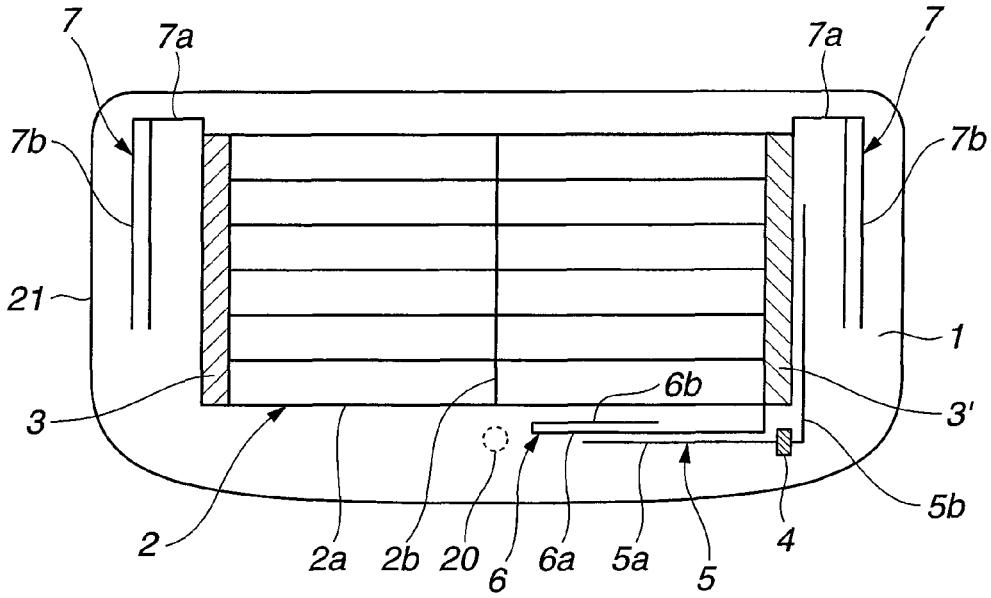
FIG. 3 is a front view showing a third embodiment provided to a window glass of an automotive rear door, and according to the present invention.

As shown in FIG. 3, there is provided the first auxiliary element 6 including at least the first auxiliary horizontal element 6*a* which branches from a lower end of one of the bus bars 3, 3' of the defogger 2 of the automotive rear window glass 1, or the lowermost one of the horizontal heater strips 2*a*, and which extends along the lowermost one of the horizontal heater strips 2*a*, and the second auxiliary element 7 including at least one of the second auxiliary vertical strips 7*b*, 7*b* which extend, respectively, from the upper ends of the bus bars 3, 3' of the defogger 2 through the extension lines along the outsides of the vertical element 5*b* of the FM radio broadcast wave receiving antenna 5 or the outside of one of the bus bars 3, 3', which are apart from the bus bars 3, 3' in the outward direction, and which extend substantially parallel with each other.

In the FM broadcast wave receiving antenna, the first auxiliary element 6 is adjacent to the horizontal element 5*a* extending in the substantially horizontal direction from the feed point 4 provided near the lower portion of one of the bus bars 3, 3' of the defogger 2 to achieve the capacitive coupling. The structure of FIG. 3 is a simplest structure pattern of the glass antenna 5 according to the present invention.

In a case in which a perforated portion 20 for mounting a wiper is provided in a central portion of the lower blank space of the defogger 2, in the first auxiliary element 6, a folded strip 6*b* is formed by bending the end portion of the first auxiliary horizontal strip 6*a* in the vertical direction before the perforated portion 20 for mounting the wiper, and then folding in an U-shape. However, in a case in which the perforated portion 20 for mounting the wiper is not provided, the first auxiliary horizontal strip 6*a* may not be folded, and the first auxiliary horizontal strip 6*a* may extend in the horizontal direction to have a predetermined length.

Moreover, there is provided the second auxiliary element 7 including at least one of the second auxiliary vertical strips 7*b*, 7*b* which extend, respectively, from the upper ends of the bus bars 3, 3' of the defogger 2 through the extension lines, which are apart from the bus bars 3, 3' in the outward direction, and which are substantially in parallel with each other. In a case in which the vertical element 5*b* of the FM radio broadcast wave receiving antenna 5 is disposed outside the bus bars 3, 3', the second auxiliary elements 7 are disposed, respectively, outside the vertical elements 5*b* of the FM radio broadcast wave receiving antenna 5.

This compensates for the short longitudinal length of the heater strip of the defogger. By providing the second vertical auxiliary element, it is possible to lengthen the longitudinal length of the strip, and to become easy to receive the polarized wave in the vertical direction.

Moreover, in general, the rear hatchback door is not made from the resin, and the rear hatchback door is made from the metal. The window frame for mounting the window glass sheet is of course made from the metal. However, in a case in which the rear door is the hatchback door made from the resin, the second auxiliary vertical strips 7*b*, 7*b* of the second auxiliary element 7 may be superimposed with the metal reinforcement frame connected with the metal body to keep a distance to achieve the capacitive coupling, or may be adjacent to the metal reinforcement frame to achieve the capacitive coupling.

The metal reinforcement frame of the rear door made from the resin includes reinforcement members which are made from the metal, and which are provided at least along the upper side, and both sides of the opening portion of the rear door.

The second auxiliary elements branching from the defogger are adjacent to the metal reinforcement frame provided at least on the upper side, and the left and right both sides of the opening portion of the door made from the resin so as to achieve the capacitive coupling. With this, the defogger receives the radio wave received by the automobile body through the metal reinforcement frame and the second auxiliary element. Moreover, it is possible to receive the FM radio broadcast wave with the high gain through the first auxiliary element and the FM broadcast wave receiving antenna arranged to achieve the capacitive coupling with the first auxiliary element.

In the FM broadcast wave receiving antenna 5, the horizontal element 5*a* is adjacent to the first auxiliary horizontal strip 6*a* to achieve the capacitive coupling. With this, the horizontally polarized component received by the defogger 2 can be picked up by the horizontal element 5*a*. Moreover, the vertical element 5*b* extending in the vertical direction along the outside of the bus bar 3' from the feed point 4 is adjacent to the bus bar 3 to achieve the capacitive coupling. With this, the vertically polarized component received by the defogger 2 can be picked up by the vertical element 5*b*.

Figure 4:
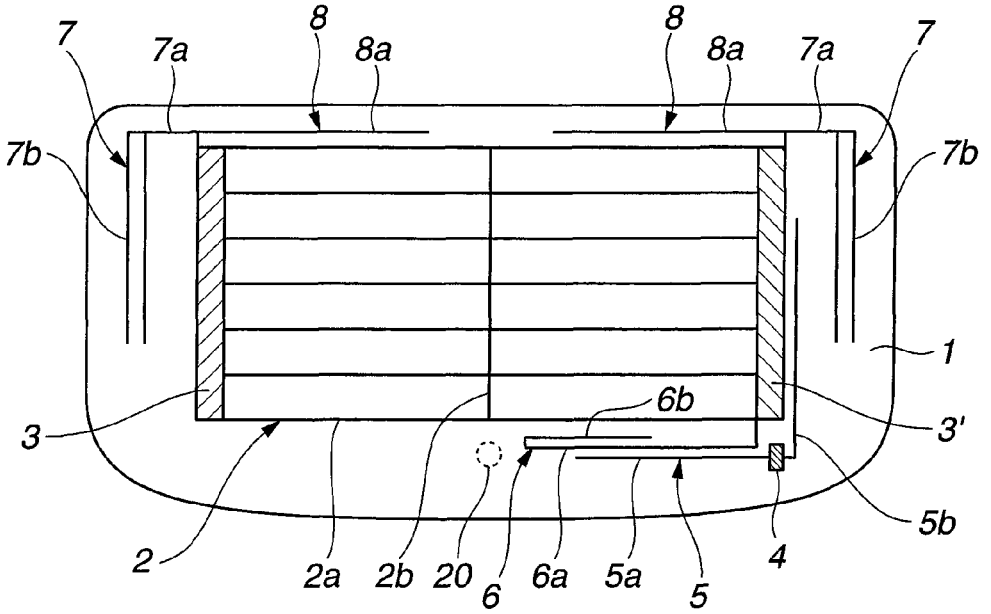
FIG. 4 is a front view showing a fourth embodiment provided to a window glass of an automotive rear door, and according to the present invention.

Moreover, as shown in FIG. 4, in addition to the second auxiliary element 7, it is optional to provide third auxiliary elements 8 each including a third auxiliary horizontal strip 8*a* which extends from the upper end of one of the bus bars 3, 3' of the defogger 2 through the extension line to a portion near the middle portion, and which is adjacent to and along the upper side of the uppermost one of the horizontal strips 2*a* of the defogger 2.

Moreover, as shown in FIG. 1, in addition to the first auxiliary element 6, the second auxiliary elements 7 and the third auxiliary elements 8 of the pattern shown in FIG. 4, it is optional to provide a fourth auxiliary element 9 including a fourth auxiliary horizontal strip 9*a* which branches from the substantially middle portion of the lowermost one of the horizontal strips 2*a* of the defogger 2, and which extends along the lowermost one of the horizontal heater strips 2*a* in a direction opposite to the feed point 4 to the lower end side of the bus bar 3, and a fourth auxiliary vertical strip 9*b* which extends from the end of the fourth auxiliary horizontal strip 9*a*, and which is adjacent to the outside of the bus bar 3.

This invention is an antenna which is suitable for a case in which there is only a small space above the defogger 2 for providing the antenna since the longitudinal length of the rear window glass 1 is short. It is preferable that the roof mount antenna (RMA) which is for receiving the AM/FM broadcast waves, and which is provided on the roof of the automobile to protrude, and one of the above-mentioned FM broadcast wave receiving antennas provided in the lower blank space, or the lateral blank spaces of the rear window glass 1 are arranged to achieve the diversity reception.

In this case, either of the roof mount antenna (RMA) or the glass antenna 5 may be the main antenna.

The defogger 2 is formed of a plurality of substantially horizontal heater strips 2*a* that are arranged at intervals substantially in parallel in a central region of the automotive rear window glass 1, and connected at their both ends with conductive bus bars 3, 3'. A battery is connected between the bus bars 3, 3'. The defogger 2 is energized to heat the defogger 2, so as to evaporate the small water droplets adhered on the outside surface of the window glass, that is, the fog, and to defog. However, the auxiliary vertical strip 2*b* perpendicular to the plurality of the horizontal heater strips 2*a*, 2*a* is not the heater strip of the defogger. The auxiliary vertical strip 2*b* is provided to pick up the radio wave of the vertically polarized wave component of the FM broadcast wave by the defogger.

The horizontal element 5*a* of the FM broadcast wave receiving antenna 5 of this embodiment is adjacent to the first auxiliary horizontal strip 6*a* of the first auxiliary element 6 which branches from and extends from the lowermost one of the horizontal heater strips 2*a* of the defogger 2 to achieve the capacitive coupling.

Although it is not shown in the drawings, the end portion of the horizontal element 5*a* of the FM broadcast wave receiving antenna 5 may be folded to form the folded horizontal strip (not shown). Moreover, a part of this folded horizontal strip of the horizontal element 5*a* may be adjacent to a part of the horizontal strip 6*a* of the first auxiliary element 6 to achieve the capacitive coupling.

The folded strip 6*b* of the first auxiliary element 6 may be folded on the lower side of the first auxiliary horizontal strip 6*a*.

It is preferable that the length of the horizontal element 5*a* and the length of the vertical element 5*b* of the FM broadcast wave receiving antenna 5 extending from the feed point 4 are, respectively, 250-450 mm and 200-400 mm in case of the FM broadcast wave receiving antenna of the frequency of 76-90 MHz for Japanese domestic use. Moreover, it is preferable that the length of the horizontal element 5*a* and the length of the vertical element 5*b* are, respectively, 150-350 mm and 200-400 mm in case of the FM broadcast wave receiving antenna of the frequency of 88-108 MHz for North America, Europe, and Australia.

A length of the strip of portions that the horizontal element 5*a* of the FM broadcast wave receiving antenna 5 and the firs auxiliary horizontal strip 6*a* of the first auxiliary element 6 are adjacent to each other to achieve the capacitive coupling is 250-450 mm in case of the FM broadcast wave receiving antenna of the frequency of 76-90 MHz for Japanese domestic use. A distance between the strips of the portions that the horizontal element 5*a* of the FM broadcast wave receiving antenna 5 and the first auxiliary horizontal strip 6*a* of the first auxiliary element 6 are adjacent to each other to achieve the capacitive coupling is 5-15 mm in case of the FM broadcast wave receiving antenna of the frequency of 76-90 MHz for Japanese domestic use.

Moreover, a length of the strip of that portions is 150-350 mm in case of the FM broadcast wave receiving antenna of the frequency of 88-108 MHz for North America, Europe, and Australia. A distance between the strips of that portions is 5-15 mm in case of the FM broadcast wave receiving antenna of the frequency of 88-108 MHz for North America, Europe, and Australia.

It is desirable that a length of the second auxiliary horizontal strip 7*a* of the second auxiliary element 7 is 40-80 mm, that a length of the second auxiliary vertical strip 7*b* is 100-300 mm, and that a length of the third auxiliary horizontal strip 8*a* of the third auxiliary element 8 is 200-480 mm.

It is desirable that a length of the fourth auxiliary strip 9*a* of the fourth auxiliary element 9 is 200-350 mm, and that a length of the fourth auxiliary vertical strip 9*b* is 200-400 mm.

It is possible to obtain a quite satisfactory reception characteristic only by the single FM broadcast wave receiving antenna 5. However, it is preferable that the diversity reception is performed by the two antennas of this antenna and the roof mount antenna (RMA) provided on the roof of the automobile. With this, it is possible to improve the directional characteristics, relative to a case of receiving by one of the two antennas.

The bus bar 3 of the defogger 2 was adjacent to the vertical element 5*b* extending from the feed point 4 near the outside of the bus bar to achieve the capacitive coupling. With this, the vertical element 5*b* becomes easy to pick up the radio wave of the vertically polarized wave component received by the defogger 2. Moreover, it is possible to obtain higher reception gain by the FM antenna 5.

The auxiliary vertical strip 2*b* perpendicular to the plurality of the substantially horizontal strips 2*a* of the defogging heater strips 2 is a neutral strip which is not energized, and which is not the defogging heater strip. The auxiliary vertical strip 2*b* may not be necessarily provided. However, the auxiliary vertical strip 2*b* is effective to make the defogging heater strips 2 operate as the antenna, and to improve the reception gain of the radio wave of the FM broadcast wave by using the radio wave received by the defogging heater strips 2.

By appropriately combining the second to fourth auxiliary elements of the auxiliary elements, and connecting with the defogger, it is possible to improve the reception gain of the horizontally polarized wave component and the vertically polarized wave component of the FM broadcast wave received by the defogger, and to obtain the stable reception characteristic.

Next, operations of this embodiment are illustrated.

The horizontal element 5*a* of the FM broadcast wave receiving antenna 5 of this embodiment was adjacent to the first auxiliary horizontal strip 6*a* of the first auxiliary element 6 branching from and extending from the lowermost one of the horizontal heater strips 2*a* of the defogger 2 to achieve the capacitive coupling. This is because it was found by the experiment that the above-structure can obtain the reception gain higher than the radio wave of the horizontally polarized wave component of the FM broadcast wave received by the antenna 5, relative to a case in which the horizontal element 5*a*' of the FM broadcast wave receiving antenna 5' is adjacent to the lowermost strip 2*a* of the defogger 2 to achieve the capacitive coupling.

With this, it is possible to pick up the radio wave of the horizontally polarized wave component of the FM radio broadcast wave received by the defogger 2 through the first auxiliary element 6, and to import to the horizontal element 5*a*.

Moreover, the vertical element 5*b* was adjacent to the bus bar 3' of the defogger 2 to achieve the capacitive coupling. With this, it is possible to pick up and import, by the vertical element 5*b*, the radio wave of the vertically polarized wave component of the FM radio broadcast wave received by the defogger 2.

At least one second auxiliary vertical strip 7*b* extending in the substantially vertical direction from the end of the second auxiliary horizontal strip 7*a* of the second auxiliary element which extends in the both outward directions from the upper ends of the bus bars 3, 3' of the defogger 2 is disposed along the outside of the vertical strip 5*b* of the FM broadcast wave receiving antenna 5. This is because it is not possible to effectively receive the radio wave of the vertical component since the length of the strip of the defogger in the vertical direction is short. The length of the strip of the heater strip of the defogger 2 in the vertical direction becomes long by providing the second auxiliary vertical strip 7*b* extending from the bus bars 3, 3' through the extension lines. With this, it is possible to effectively receive the radio wave of the vertical component.

In a case in which the rear hatchback door is made from the resin, the second auxiliary vertical strip of the second auxiliary element is superimposed, with the distance, with the metal reinforcement frame grounded to the metal body, or is adjacent to the metal reinforcement frame to achieve the capacitive coupling. With this, it is possible to import the radio wave received by the automobile body by the capacitive coupling of the metal reinforcement frame and the second auxiliary element, and further to receive the FM radio broadcast wave with the high gain through the first auxiliary element and the FM radio broadcast wave receiving antenna which achieves the capacitive coupling with the first auxiliary element.

Moreover, in the case in which the rear hatchback door is made from the resin, the metal reinforcement frame is formed, as the metal window frame, at least at the upper side and the both sides of the peripheral portion of the opening portion of the rear door for reinforcing the hatchback door made from the resin, and for importing the radio wave received by the automobile body.

Moreover, the third auxiliary element 8 was provided at the uppermost one of the horizontal heater strip 2*a* of the defogger 2. With this, it is possible to become easy to receive the radio wave of the FM broadcast wave (specifically, the vertically polarized wave) by adjusting the length of the horizontal strip to the wave length $\lambda/4$ of the central frequency 90 MHz of the FM broadcast wave band. The fourth auxiliary element 9 was provided at the lowermost one of the horizontal heater strips 2*a* of the defogger 2. With this, it is possible to adjust the impedance to the wave length of the target frequency.

Embodiments

Hereinafter, the present invention is illustrated in detail with reference to the drawings.

First Embodiment

As shown in FIG. 1, the FM broadcast wave receiving antenna 5 of frequency of 88-108 MHz for North America, Europe and Australia was provided in a corner portion in a lower space of the defogger 2 of the window glass mounted in the metal window frame of the rear hatchback door for the automobile. Moreover, first to fourth auxiliary elements 6-9 were provided in peripheral blank spaces above and below the defogger 2, and in peripheral blank spaces on left and right sides of the defogger 2. The first to fourth auxiliary elements 6-9 were connected with the defogger 2.

A distance of the upper blank space of the defogger 2 between the uppermost one of the horizontal heater strips 2*a* and the flange opening portion 21 is short, and is substantially 30 mm. A distance of the lower space of the defogger 2 between the lowermost one of the horizontal heater strips 2*a* and the lower side of the flange opening portion is 60 mm, and is short relative to the general distance. As to the lateral blank spaces, a distance between each of the bus bars 3, 3' and one of longitudinal sides of the flange opening is substantially 10 mm. However, there is a space with a distance of substantially 100 mm from the flange opening portion to the adhesive around the glass.

The FM broadcast wave receiving antenna 5 includes a horizontal element 5*a* extending in the horizontal direction from a feed point 4 provided near one of the bus bars 3, and a vertical element 5*b* extending in the vertical direction from the feed point 4.

A perforated portion 20 is formed in a central space of the lower blank space of the defogger 2. The perforated portion 20 is for driving the wiper for the rear window glass.

Therefore, the first auxiliary element 6 includes a first auxiliary horizontal strip 6*a* extending in the horizontal direction from an end of an extension line which branches from a portion of the lowermost one of the horizontal heater strips near the right bus bar 3 of the defogger 2, and which extends in the downward direction; and a folded strip 6*b* formed by bending the end of the auxiliary horizontal strip 6*a* in the upward direction, and then further folding the end of the auxiliary horizontal strip 6*a*.

The horizontal element 5*a* of the FM broadcast wave receiving antenna 5 of this embodiment was adjacent to first auxiliary horizontal strip 6*a* to achieve the capacitive coupling. The vertical element 5*b* was adjacent to the bus bar 3' of the defogger 2 to achieve the capacitive coupling.

The auxiliary elements 7 were disposed, respectively, in the outward directions from ends of extension lines each extending in the upward direction from an upper end of one of the bus bar 3, 3' of the defogger 2. The auxiliary elements 8 were disposed, respectively, in the inward directions from the ends of the extension lines.

Each of the second auxiliary elements 7 includes the second auxiliary horizontal strip 7*a* disposed in the outward direction from the end of one of the extension lines extending in the upward direction from the upper end of one of the bus bars 3, 3'; and two second vertical strips which extend in the downward direction from the end of one of the extension lines, and which are adjacent to each other.

Moreover, each of the third auxiliary elements 8 includes a third auxiliary horizontal strip 8*a* extending in the inward direction from the end of the extension line to a substantially middle portion of the defogger 2.

Furthermore, the fourth auxiliary element 9 includes a fourth auxiliary horizontal strip 9*a* which branches from a substantially middle portion of the lowermost one of the horizontal heater strips 2*a* of the defogger 2, which extends toward the lower end side of the bus bar 3 that is opposite to the feed point 4, and which is adjacent to and along the lowermost one of the horizontal heater strips 2*a*; and a fourth auxiliary vertical strip 9*b* which further extends from an end of the fourth auxiliary horizontal strip 9*a*, and which is adjacent to and along the outside of the lower end portion of the bus bar 3.

The defogger 2 has a pattern shape including a plurality of the horizontal heater strips 2*a*, 2*a*, . . . ; and an auxiliary vertical strip 2*b* perpendicular to the plurality of the horizontal heater strips 2*a*, 2*a*, . . . at middle portions of the horizontal heater strips 2*a*, 2*a*, . . . .

The glass plate 1 used in the first embodiment has a substantially rectangular shape. The glass plate 1 has outline dimensions of an upper side of 1,200 mm, a lower side of 1,200 mm, and a height of 550 mm. An inside size of the flange of the window frame are an upper side of 1,100 mm, a lower side of 1,100 mm, and a height of 500 mm.

A length of the horizontal element 5*a* of the antenna 5 of this embodiment=215 mm A length of the vertical element 5*b*=360 mm A length of the first auxiliary horizontal strip 6*a* of the first auxiliary element 6=325 mm A length of the folded strip 6*b*=250 mm Each distance between the first auxiliary horizontal strip 6*a* and the lowermost one of the horizontal heater strips 2*a* of the defogger=30 mm A distance between the horizontal element 5*a* and the first auxiliary horizontal strip 6*a*=5 mm A distance between the vertical element 5*b* and the bus bars 3, 3'=10 mm A length of the second auxiliary horizontal strip 7*a* of the second auxiliary element 7=65 mm Lengths of the second auxiliary vertical strips 7*b*, 7*b*=235 mm, 235 mm A distance between the two second auxiliary vertical strips 7*b*, 7*b*=20 mm A distance between the second auxiliary vertical strip 7*b* and the bus bar 3'=30 mm A length of the third auxiliary horizontal strip 8*a* of the third auxiliary element 8=475 mm A distance between the third auxiliary horizontal strip 8*a* and the uppermost one of the horizontal heater strips 2*a* of the defogger=10 mm A length of the fourth auxiliary horizontal strip 9*a* of the fourth auxiliary element 9=340 mm A length of the fourth auxiliary vertical strip 9*b*=375 mm A distance between the fourth auxiliary vertical strip 9*a* and the lowermost one of the horizontal heater strips 2*a*=5 mm A distance between the fourth auxiliary vertical strip 9*b* and the bus bar 3=10 mm The feed point 4 is located at a position which is apart from the lower end of the bus bar 3' by 65 mm.

The FM broadcast wave receiving antenna 5, the auxiliary elements 6-9, the heating conductive strips 2, the feed point 4 and the bus bars 3, 3' are formed by printing on the glass sheet by the conductive paste such as silver paste, and then baking.

Thus-obtained window glass sheet was mounted in the rear window of the automobile. Moreover, the FM broadcast wave receiving antenna 5 was connected from the feed point through a feeder line to an FM tuner (not shown).

The FM broadcast wave receiving antenna 5 and a roof mount antenna (RMA) (not shown) were arranged to achieve the diversity reception so as to improve the directional characteristics.

Figure 6:
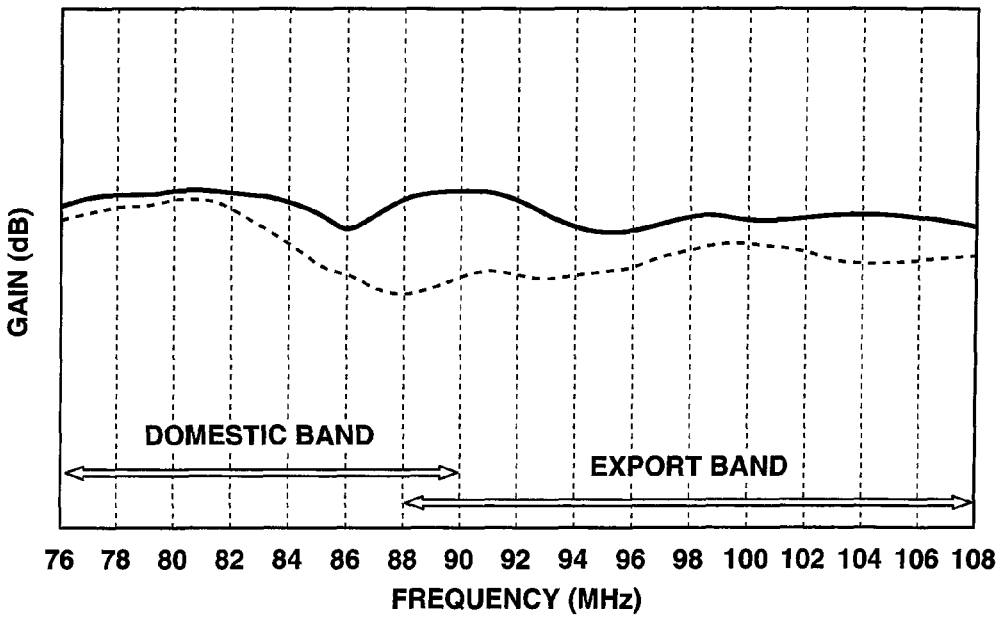
FIG. 6 is a frequency characteristic view of a horizontally polarized wave in the first embodiment and the comparative example.
Figure 7:
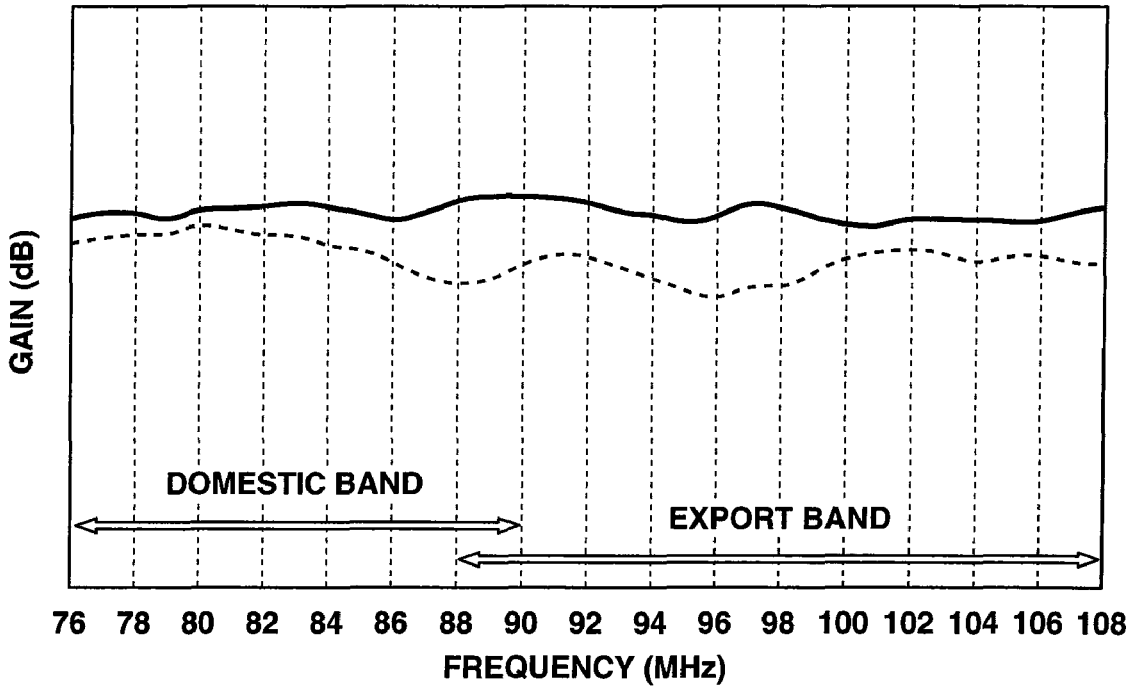
FIG. 7 is a frequency characteristic view of a vertically polarized wave in the first embodiment of the present invention and the comparative example.

As shown by heavy lines of frequency characteristic views of FIGS. 6 and 7, in case of receiving by the FM antenna 5, the average reception gain of the horizontally polarized wave of the FM broadcast wave band of 88 MHz-108 MHz for North America, Europe, and Australia became −18.5 dB, and the average reception gain of the vertically polarized wave became −16.5 dB (dipole ratio). As a result of the diversity reception by the two antenna systems of the FM antenna 5 and the AM/FM roof mount antenna (RMA) (not shown), it was found to obtain a reception gain with very good directional characteristics in 88 MHz-108 MHz.

In this way, the various auxiliary elements were provided to the defogger to receive the radio wave of the FM broadcast wave with the high gain. By the FM broadcast wave receiving antenna 5 arranged to achieve the capacitive coupling with the first auxiliary element branching from and connecting with the defogger 2 which received the radio wave of the FM broadcast wave with the high gain, it became possible to pick up the FM broadcast wave with the high sensitivity.

Second Embodiment

Figure 2:
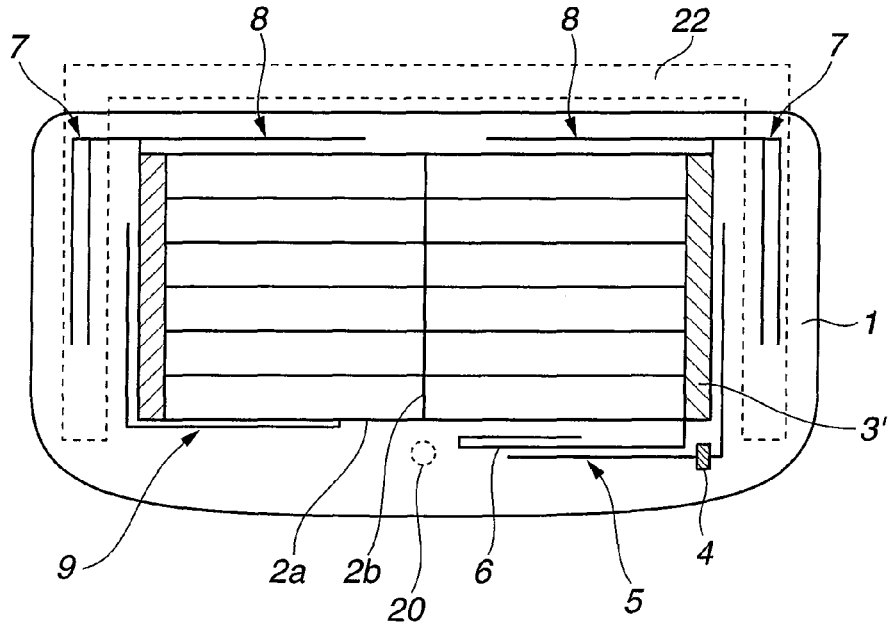
FIG. 2 is a front view showing a second embodiment provided to a window glass of an automotive rear door made from a resin, and according to the present invention.

In the second embodiment shown in FIG. 2, the rear hatchback door for the automobile was made from the resin. The FM broadcast wave receiving antenna 5 of the frequency of 88-108 MHz for North America, Europe and Australia was provided in a corner portion in a lower space of the defogger 2 of the window glass mounted in the opening portion of the window frame. Moreover, first to fourth auxiliary elements 6-9 were provided in peripheral blank spaces above and below the defogger 2, and in peripheral blank spaces on left and right sides of the defogger 2. The first to fourth auxiliary elements 6-9 were connected with the defogger 2.

The patterns, the sizes and so on of the FM broadcast wave receiving antenna 5 and the first to fourth auxiliary elements 6-9 are identical to those in the first embodiment. In this second embodiment, the rear door is the hatchback door made from the resin. The second auxiliary vertical strips 7*b*, 7*b* of the second auxiliary element 7 and the metal reinforcement frame connected with the metal body were superimposed to maintain a distance capable of achieving the capacitive coupling so as to achieve the capacitive coupling. The rear door made from the resin was provided with the metal reinforcement frames extending along the upper side and the both lateral sides of the opening portion of the rear door.

Each of the second auxiliary elements 7 includes the two second auxiliary vertical strips 7*b*, 7*b* each of which extends from an upper end of one of the bus bars 3, 3' through an extension line, which are apart from the bus bars 3, 3' in the outside direction, and which are substantially in parallel with each other.

Like the first embodiment, the FM broadcast wave receiving antenna 5 was connected from the feed point 4 to a tuner (not shown). Moreover, in this embodiment, a length of each strip of the FM broadcast wave receiving antenna 5, and a length and a distance of each strip of the first auxiliary element are identical to those of the first embodiment.

The FM broadcast wave receiving antenna 5, the defogger 2, the feed point 4, and the bus bars 3, 3' are formed by printing on the glass sheet by the conductive paste such as the silver paste, and then baking.

Thus-obtained window glass sheet was mounted in the rear window of the automobile. Moreover, the FM broadcast wave receiving antenna 5 was connected from the feed point 4 through the feeder line to the FM tuner (not shown).

The FM broadcast wave receiving antenna 5 and the roof mount antenna (RMA) (not shown) were arranged to achieve the diversity reception so as to improve the directional characteristics In case of receiving by the FM antenna 5, the average reception gain of the horizontally polarized wave of the FM broadcast wave band of 88 MHz-108 MHz for North America, Europe, and Australia became −18.1 dB, and the average reception gain of the vertically polarized wave became −16.3 dB (the dipole ratio). As a result of the diversity reception by the two FM antenna systems of the FM antenna 5 and the AM/FM roof mount antenna (RMA) (not shown), it was found to obtain a reception gain with very good directional characteristics in 88 MHz-108 MHz.

Third Embodiment

In a third embodiment shown in FIG. 3, the first auxiliary element 6 and the second auxiliary element 7 were connected with the defogger of the first embodiment. The horizontal element 5*a* of the FM antenna 5 was adjacent to the first auxiliary horizontal strip 6*a* of the first auxiliary element 6 to achieve the capacitive coupling. The vertical element 5*b* of the FM antenna 5 was adjacent to the bus bar 3' of the defogger to achieve the capacitive coupling. Lengths of the first auxiliary element 6 and the second auxiliary element 7 are identical to those of the first embodiment. Distances between the defogger 2 and each of the first auxiliary element 6 and the second auxiliary element 7 are identical to those of the first embodiment. In the third embodiment, there are not provided the third and fourth auxiliary elements, unlike the second embodiment.

Like the first embodiment, the FM broadcast wave receiving antenna 5 was connected from the feed point 4 to the tuner (not shown). Moreover, in this embodiment, a length of each strip of the FM broadcast wave receiving antenna 5, and a length and a distance of each strip of the first auxiliary element are identical to those of the first embodiment.

The FM broadcast wave receiving antenna 5, the defogger 2, the feed point 4, and the bus bars 3, 3' are formed by printing on the glass sheet by the conductive paste such as the silver paste, and then baking.

Thus-obtained window glass sheet was mounted in the rear window of the automobile. Moreover, the FM broadcast wave receiving antenna 5 was connected from the feed point 4 through the feeder line to the FM tuner (not shown).

The FM broadcast wave receiving antenna 5 and the roof mount antenna (RMA) (not shown) were arranged to achieve the diversity reception so as to improve the directional characteristics.

In case of receiving by the FM antenna 5, the average reception gain of the horizontally polarized wave of the FM broadcast wave band of 88 MHz-108 MHz for North America, Europe, and Australia became −19.0 dB, and the average reception gain of the vertically polarized wave became −17.1 dB (the dipole ratio). As a result of the diversity reception by the two FM antenna systems of the FM antenna 5 and the AM/FM roof mount antenna (RMA) (not shown), it was found to obtain a reception gain with very good directional characteristics in 88 MHz-108 MHz.

Fourth Embodiment

In a fourth embodiment shown in FIG. 4, the first auxiliary element 6, the second auxiliary element 7 and the third auxiliary element 8 were connected with the defogger of the first embodiment. The horizontal element 5*a* of the FM antenna 5 was adjacent to the first auxiliary horizontal strip 6*a* of the first auxiliary element 6 to achieve the capacitive coupling. The vertical element 5*b* of the FM antenna 5 was adjacent to the bus bar 3' of the defogger to achieve the capacitive coupling. Lengths of the first auxiliary element 6, the second auxiliary element 7 and the third auxiliary element 8 are identical to those of the first embodiment. Distances between the defogger 2 and each of the first auxiliary element 6, the second auxiliary element 7 and the third auxiliary element 8 are identical to those of the first embodiment. In the fourth embodiment, there are not provided the fourth auxiliary element, unlike the first embodiment.

Like the first embodiment, the FM broadcast wave receiving antenna 5 was connected from the feed point 4 to the tuner (not shown). Moreover, in this embodiment, a length of each strip of the FM broadcast wave receiving antenna 5, and a length and a distance of each strip of the first auxiliary element are identical to those of the first embodiment.

The FM broadcast wave receiving antenna 5, the defogger 2, the feed point 4, and the bus bars 3, 3' are formed by printing on the glass sheet by the conductive paste such as the silver paste, and then baking.

Thus-obtained window glass sheet was mounted in the rear window of the automobile. Moreover, the FM broadcast wave receiving antenna 5 was connected from the feed point 4 through the feeder line to the FM tuner (not shown).

The FM broadcast wave receiving antenna 5 and the roof mount antenna (RMA) (not shown) were arranged to achieve the diversity reception so as to improve the directional characteristics.

In case of receiving by the FM antenna 5, the average reception gain of the horizontally polarized wave of the FM broadcast wave band of 88 MHz-108 MHz for North America, Europe, and Australia became −18.8 dB, and the average reception gain of the vertically polarized wave became −16.8 dB (the dipole ratio). As a result of the diversity reception by the two FM antenna systems of the FM antenna 5 and the AM/FM roof mount antenna (RMA) (not shown), it was found to obtain a reception gain with very good directional characteristics in 88 MHz-108 MHz.

Comparative Example

Figure 5:
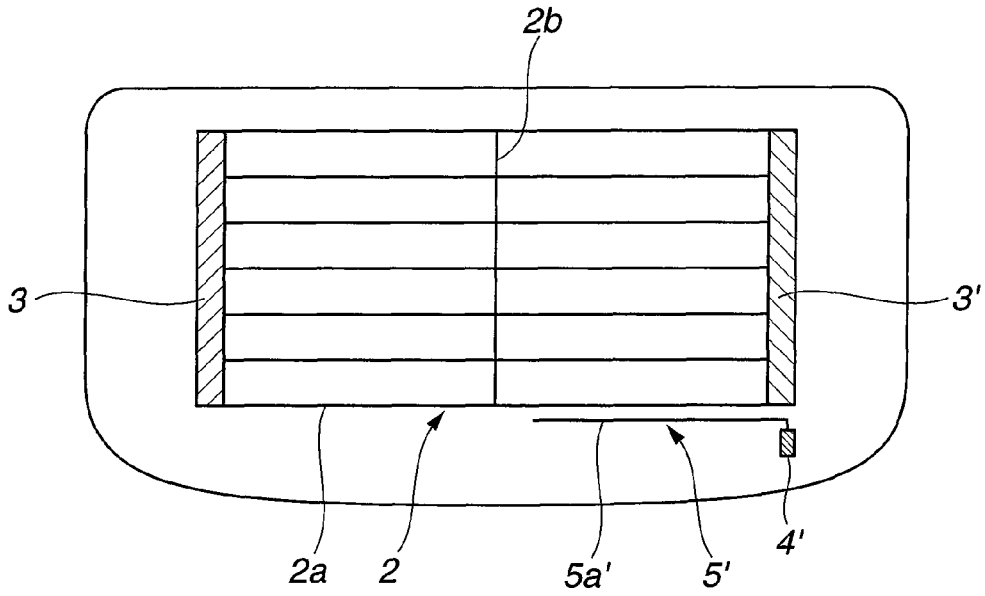
FIG. 5 is a front view showing an antenna of a comparative example 1.

As shown in FIG. 5, an FM broadcast wave receiving antenna 5' of the frequency of 88-108 MHz for North America, Europe and Australia was provided in a corner portion in a lower space of the defogger 2 of the rear window glass for the automobile.

The FM broadcast wave receiving antenna 5' includes a horizontal element 5*a*' extending in the horizontal direction from a feed point 4' provided near a lower end portion of a right bus bar 3' of the defogger 2.

The horizontal element 5*a*' was adjacent to the lowermost one of the horizontal heater strips 5*a* of the defogger to achieve the capacitive coupling.

The FM broadcast wave receiving antenna 5', the defogger 2', the feed point 4, and the bus bars 3, 3' are formed by printing on the glass sheet by the conductive paste such as the silver paste, and then baking.

Thus-obtained window glass sheet was mounted in the rear window of the automobile. Moreover, the FM broadcast wave receiving antenna 5 was connected from the feed point 4 through the feeder line to the FM tuner (not shown).

As shown by narrow lines of frequency characteristic views of FIGS. 6 and 7, in case of receiving by the FM antenna 5', the average reception gain of the horizontally polarized wave of the FM broadcast wave band of 88 MHz-108 MHz for North America, Europe, and Australia became −24.8 dB, the average reception gain of the vertically polarized wave became −21.2 dB (the dipole ratio). It was found that a satisfactory reception gain can not be obtained relative to the FM antenna 5.

The invention claimed is:

1. An automotive glass antenna which is an FM radio broadcast wave receiving antenna provided in blank spaces below or lateral sides of a defogger of a window glass provided in a rear door of a hatchback type of an automobile, the automotive glass antenna comprising:

a first auxiliary element including at least a first auxiliary horizontal strip which branches from a lower end of a bus bar of the defogger, or from a lowermost horizontal heater strip, and which extends along the lowermost heater strip;

a second auxiliary element including at least a second auxiliary vertical strip which extends from an upper end of each bus bar through an extension line, and which is apart from the bus bar in an outward direction;

a horizontal element which extends in a substantially horizontal direction from a feed point provided near a lower portion of the bus bar of the defogger, and which is adjacent to the first auxiliary horizontal strip to achieve a capacitive coupling; and a vertical element which extends from the feed point along an outside of the bus bar, and which is adjacent to the bus bar to achieve the capacitive coupling.

2. The automotive glass antenna as defined in claim 1, wherein the automotive glass antenna comprises a third auxiliary element including a third auxiliary horizontal strip which extends from the upper end of each bus bar of the defogger through the extension line along an upper side of an uppermost heater horizontal strip of the defogger, to a portion near a middle portion of the uppermost heater horizontal strip, and which is adjacent to the upper side of the uppermost heater horizontal strip.

3. The automotive glass antenna as defined in claim 1, wherein the automotive glass antenna comprises a fourth auxiliary element including a fourth auxiliary horizontal strip which branches from a substantially middle portion of the lowermost horizontal heater strip of the defogger, and which extends along the lowermost horizontal heater strip in a direction opposite to the feed point, and a fourth auxiliary vertical strip which extends from an end of the fourth auxiliary horizontal strip, and which is adjacent to an outside of the bus bar.

4. The automotive glass antenna as defined in claim 1, wherein the rear door is made from a resin; metal reinforcement frames are provided at least in upper side, both lateral sides of a periphery portion of an opening portion of the rear door; the metal reinforcement frames are grounded to a metal body; the second auxiliary vertical strip of the second auxiliary element is superimposed with or adjacent to the metal reinforcement frame with a distance to achieve the capacitive coupling.

5. The automotive glass antenna as defined in claim 1, wherein the rear window glass is a window glass having no blank space above the defogger for providing the antenna; and the FM broadcast wave receiving antenna provided in the blank spaces below or on the lateral sides of the rear window glass is arranged to achieve a diversity reception with a roof mount antenna for receiving AM/FM broadcast waves.

6. The automotive glass antenna as defined in claim 2, wherein the automotive glass antenna comprises a fourth auxiliary element including a fourth auxiliary horizontal strip which branches from a substantially middle portion of the lowermost horizontal heater strip of the defogger, and which extends along the lowermost horizontal heater strip in a direction opposite to the feed point, and a fourth auxiliary vertical strip which extends from an end of the fourth auxiliary horizontal strip, and which is adjacent to an outside of the bus bar.

7. The automotive glass antenna as defined in claim 6, wherein the rear door is made from a resin; metal reinforcement frames are provided at least in upper side, both lateral sides of a periphery portion of an opening portion of the rear door; the metal reinforcement frames are grounded to a metal body; the second auxiliary vertical strip of the second auxiliary element is superimposed with or adjacent to the metal reinforcement frame with a distance to achieve the capacitive coupling.

8. The automotive glass antenna as defined in claim 6, wherein the rear window glass is a window glass having no blank space above the defogger for providing the antenna; and the FM broadcast wave receiving antenna provided in the blank spaces below or on the lateral sides of the rear window glass is arranged to achieve a diversity reception with a roof mount antenna for receiving AM/FM broadcast waves.

9. The automotive glass antenna as defined in claim 4, wherein the rear window glass is a window glass having no blank space above the defogger for providing the antenna; and the FM broadcast wave receiving antenna provided in the blank spaces below or on the lateral sides of the rear window glass is arranged to achieve a diversity reception with a roof mount antenna for receiving AM/FM broadcast waves.

10. The automotive glass antenna as defined in claim 7, wherein the rear window glass is a window glass having no blank space above the defogger for providing the antenna; and the FM broadcast wave receiving antenna provided in the blank spaces below or on the lateral sides of the rear window glass is arranged to achieve a diversity reception with a roof mount antenna for receiving AM/FM broadcast waves.

* * * * *